US007338326B2

(12) United States Patent
Su

(10) Patent No.: US 7,338,326 B2
(45) Date of Patent: Mar. 4, 2008

(54) ELECTRONIC CARD CONNECTOR

(75) Inventor: Yu-Hung Su, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/409,966

(22) Filed: Apr. 25, 2006

(65) Prior Publication Data

US 2007/0249234 A1 Oct. 25, 2007

(51) Int. Cl.
*H01R 25/00* (2006.01)

(52) U.S. Cl. ..... 439/638; 439/630

(58) Field of Classification Search ..... 439/638–639, 439/630–632
See application file for complete search history.

(56) References Cited

U.S. PATENT DOCUMENTS 6,916,208 B2 * 7/2005 Chen et al. ..... 439/639
6,976,624 B2 * 12/2005 Hsiao ..... 235/451

* cited by examiner

*Primary Examiner*—Truc Nguyen
(74) *Attorney, Agent, or Firm*—Birch, Stewart, Kolasch & Birch, LLP

(57) ABSTRACT

An electronic card connector includes a dielectric housing, a fixing device, a plurality of first electric terminals and second electric terminals. A first electronic card slot and a second electronic card slot are formed in the dielectric housing. A fixed concave is formed in the second base. A bracket is arranged in the base of the fixed concave. The fixed concave set through rightward into the first electronic card slot. The first electric terminals and the second electric terminals are located in the dielectric housing. The fixing device has sustaining portion, locating portion and the connecting portion which is connected the sustaining portion and the locating portion. The fixing device is located on the bracket. While a first electronic card is inserted into the first electronic card slot, the sustained piece will cover the first electronic card.

11 Claims, 10 Drawing Sheets

ELECTRONIC CARD CONNECTOR

BACKGROUND OF THE INVENTION

1. Field of the Invention

This present invention relates to a connector mounted to an electronic appliance such as portable telephones, telephones, PDA and the like, more specifically to an electronic card connector which can be loaded simultaneously with two different cards differing in outer shape, contact pad position or the like.

2. The Related Art

In recent years, electronic cards have become popular and a wide variety of electronic cards have been used, which are different in outer shape, contact pad position or the like. The electronic card connector is provided for use in an electronic appliance to adopt an electronic card. There is a need for a card connector which can accommodate at least two different electronic cards.

A traditional electronic card connector, applied to portable telephones and the like, comprises a housing, a cover for covering the housing, a plurality of connecting terminals located in the housing, two slots accepted two kinds of cards, while the two electronic cards are inserted to the traditional electronic card connector, a fixing device located in the cover is used to fasten one of the two electronic cards which are inserted into the traditional electronic card connector.

The traditional electronic card connector is described above. A fixing device installed in the cover is used to fasten the electronic cards installed in the traditional electronic card. While the cover having the fixing device is pushed forward or backward, the electronic card would be shook and departed from the slot by the cover covered on the electronic card. So that the electronic card is not fastened in the slot exactly, the electric signal between the electronic card and the portable telephone is not transmitted constantly.

Accordingly, in order to deliver constantly signal between the electronic card and the portable telephone, it is necessary to located the electronic card in the electronic card connector. In other words, the traditional electronic card connector described above has a problem in that the electronic card is not located while the cover pushes forward or backward, and the electronic card is not inserted and fetched in the electronic card connector.

SUMMARY OF THE INVENTION

An object of the invention is to provide an electronic card connector comprising a dielectric housing, a fixing device, a plurality of first electric terminals and second electric terminals. The dielectric housing has two card slots. The first electronic card slot is arranged longitudinal. The second electronic card slot is arranged sidelong. The plurality of first electric terminal slots and second terminal slots are formed in the bottom of the first electronic card slot and the base of the second electronic card slot respectively. A fixed concave is formed in the base. A bracket is arranged in the bottom of the fixed concave. The fixed concave is placed rightward into the first electronic card slot by the sidewall of the first electronic card slot and formed a pressed plate. The fixed concave is extended leftward to the bottom of the base. The first electric terminals and the second electric terminals are located in the first electric terminal slots and the second electric terminal slots correspondingly. The fixing device includes a sustaining portion, a locating portion and a connecting portion which is connected to the sustaining portion and the locating portion. The fixing device is located on the bracket. A sustained piece and a moved piece are arranged in the sustaining portion. The locating portion is located in the left end of the fixed concave. The sustaining piece is arranged under the pressed plate. While the first electronic card is inserted into the first electronic card slot, the sustained piece will cover over the first electronic card and the second electronic card will not affect the location of the first electronic card.

Another object of the invention is to provide an electronic card connector, comprising a dielectric housing, a fixing device, a plurality of first electric terminals. The dielectric housing includes a base and a first electronic card slot, a plurality of first electric terminal slots arranged in the bottom of the first electronic card slot, a left wall and a right wall are mounted in both sides of the first electronic card slot. The first electric terminals are accepted in the first electric terminal slots. The fixing device includes a sustaining portion, a locating portion and a connecting portion connected to the sustaining portion and the locating portion. A sustained piece and a moved piece are installed in the sustaining portion. A fixed concave is formed in the base A bracket is arranged in the bottom of the fixed concave The fixed concave sets through rightward into the first electronic card slot by the sidewall of the first electronic card slot. The fixed concave extended leftward to the bottom of the base. The locating portion is located in the left end of the fixed concave. The sustaining portion is arranged under the pressed plate. While the first electronic card is inserted into the first electronic card slot, the sustained piece can located the first electronic card in the first electronic card slot firmly.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
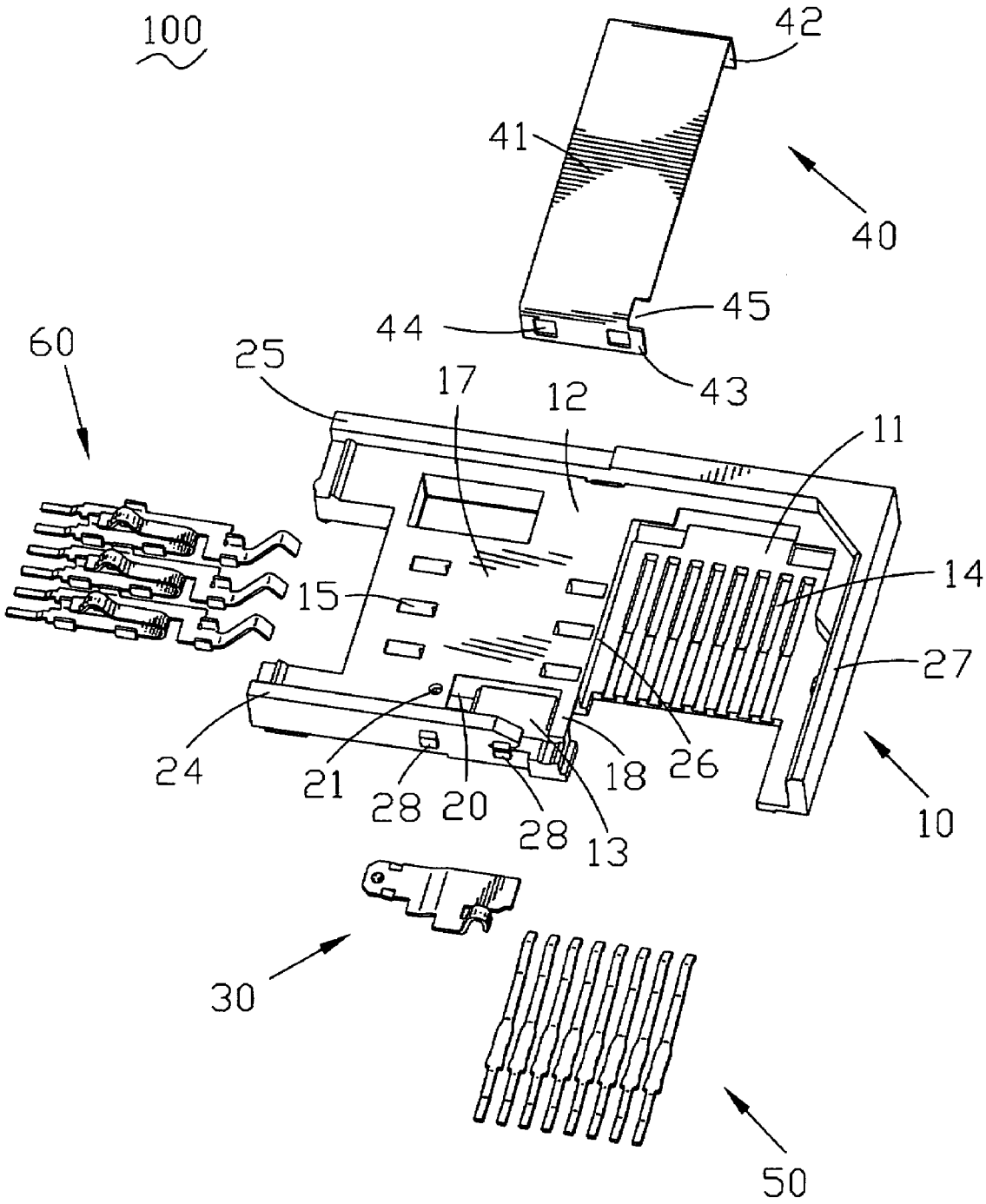
FIG. 1 is an exploded perspective view of an electronic card connector according to the present invention.

First referring to FIG. 1, an electronic card connector 100 comprises a dielectric housing 10, a plurality first electric terminals 50 and second electric terminals 60, a fixing device 30 and a cover 40.

Figure 2:
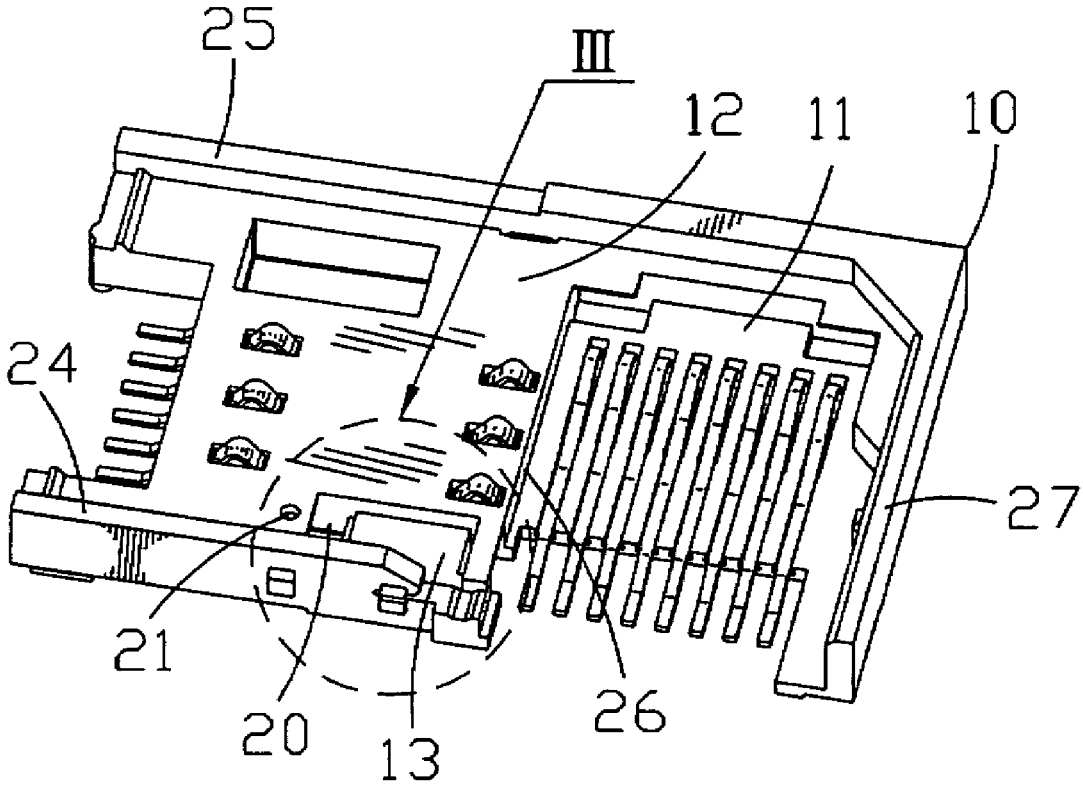
FIG. 2 is an assembled perspective view of the first electric terminals, the second electric terminals and the dielectric housing.
Figure 3:
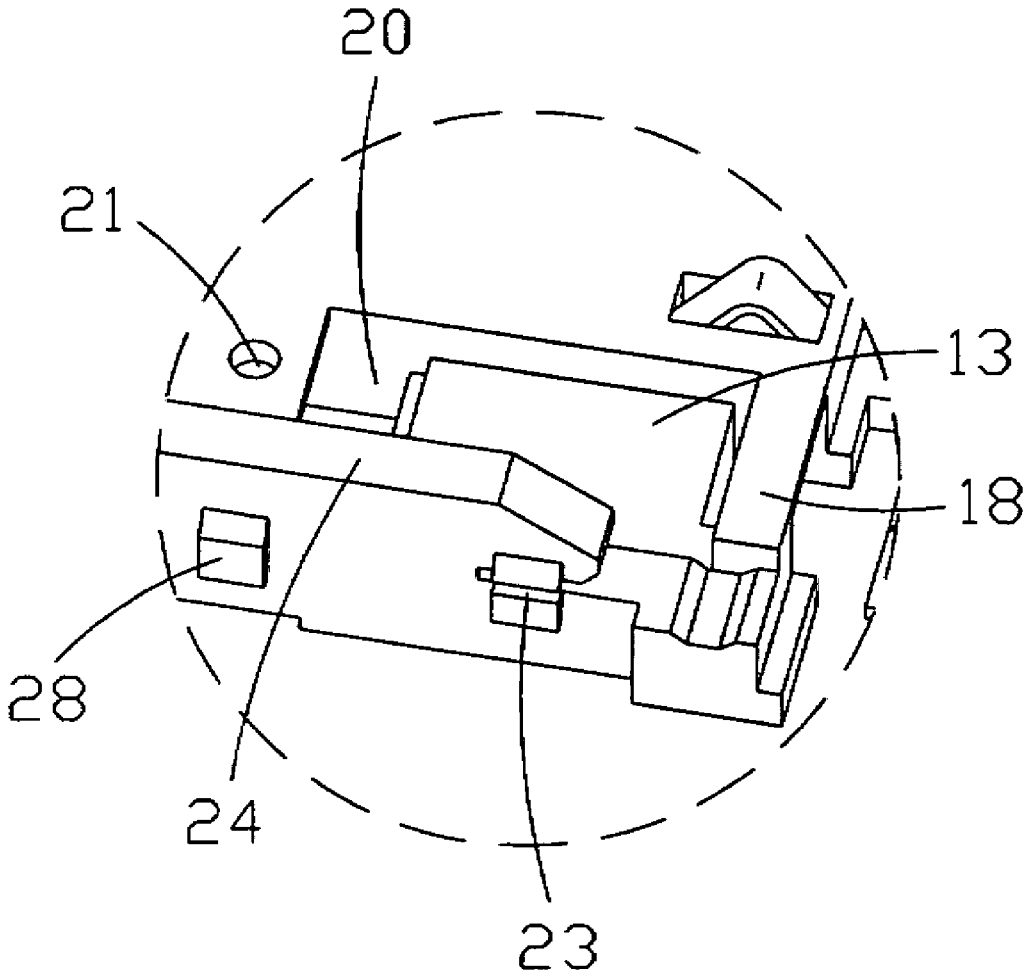
FIG. 3 is a partial, enlarged view of the fixed concave of the dielectric housing in the FIG. 2.

Please refer to FIG. 1 to FIG. 3, a first electronic card slot 11 and a second electronic card slot 12 are shown. The first electronic card slot 11 is arranged longitudinally in the dielectric housing 10, the second electronic card slot 12 is arranged sidelong in the dielectric housing 10. The second electronic card slot 12 are located above the first electronic card slot 11. A base 17 of the second electronic card slot 12 is located in the bottom of the second electronic card slot 12. The right side of the base 17 dents to the first electronic card slot 11. The two rows of the second electronic terminal slots 15 are arranged in the base 17. A front wall 24 and a back wall 25 are located erect in the two sides of the base 17. A plurality of first electric terminal slots 14 are formed in the bottom of the first electronic card slot 11. The right end of the base 17 is severed and formed a left wall 26 of the first electronic card slot 11. A right wall 27 is formed in the right end of the dielectric housing 10. The first electronic card slot 11 formed in the right side of the dielectric housing 10. The entrance of the second electronic card slot 12 is arranged in the left end of the dielectric housing 10. A fixed concave 20 adjacent to the front wall 24 is formed in the base 17. A bracket 13 is arranged in the bottom of the fixed concave 20. The fixed concave 20 extends leftward the bottom of the base 17. A fixed hole 21 is formed in the base 17 and connected to the fixed concave 20. The fixed concave 20 extends rightward and connected the first electronic card slot 11. A pressed plate 18 is formed on the top of the right end of the fixed concave 20. A limited groove 23 is formed horizontally in the front wall 24. Two lumps 28 are located in the outside of the front wall 24 and the back wall 25, respectively.

Referring to FIG. 1 again, the cover 40 includes a plate 41, a front side wall 43 and a back side wall 42, two plackets 44 formed in the front side wall 43 and the back side wall 42 respectively, and a gap 45 formed in the connection of the right end of the plate 41 and the front side wall 43.

Figure 4:
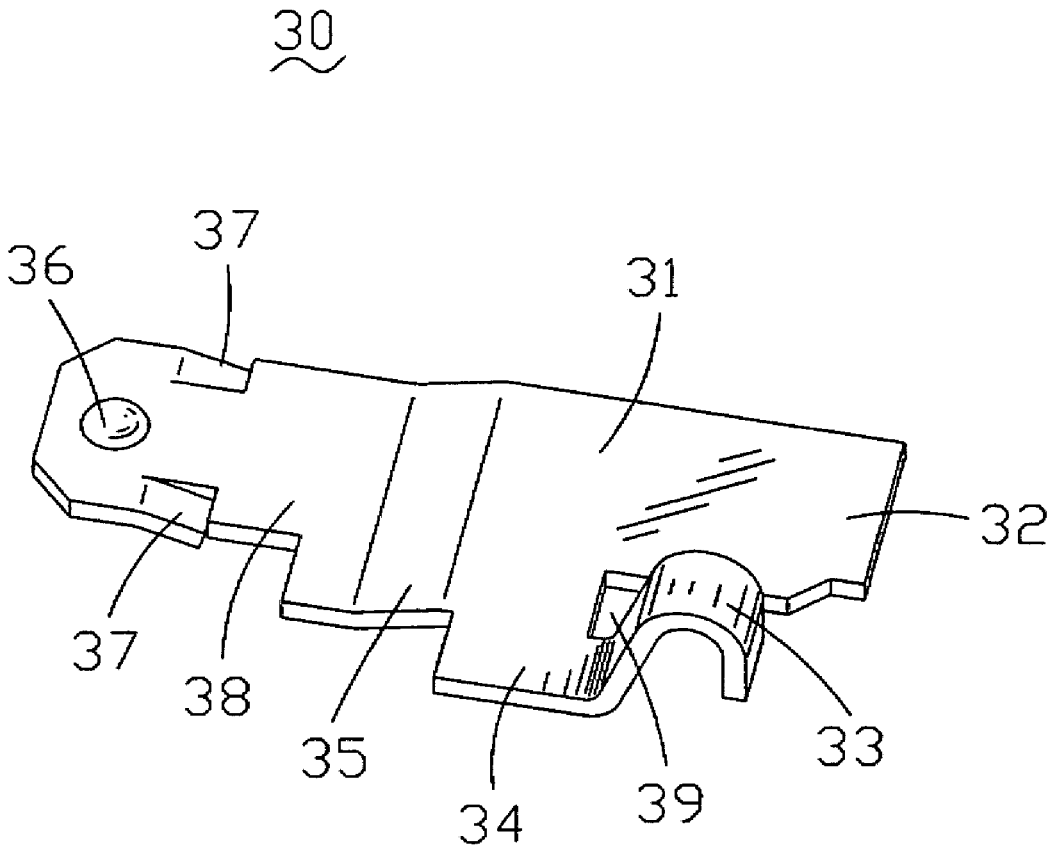
FIG. 4 is an enlarged view of the fixed device of the electronic card connector.

Please refer to FIG. 4, a fixing device 30 includes a sustaining portion 31 in the front of the fixing device 30, a locating portion 38 in the back of the fixing device 30 and a connecting portion 35 connected slantwise the sustaining portion 31 and the locating portion 38. A sustained piece 32 and a moved piece 33 are installed in the sustaining portion 31. The moved piece 33 has a generally vaulted shape. A rectangular slot 39 is formed in the sustaining portion 31 and located between the sustained piece 32 and the moved piece 33. The limited patch 34 extends horizontally from the end of the moved piece 33. A protruding lump 36 is formed upward on the locating portion 38. Two protruding elements 37 are formed downward at both sides of the locating portion 38.

Figure 5:
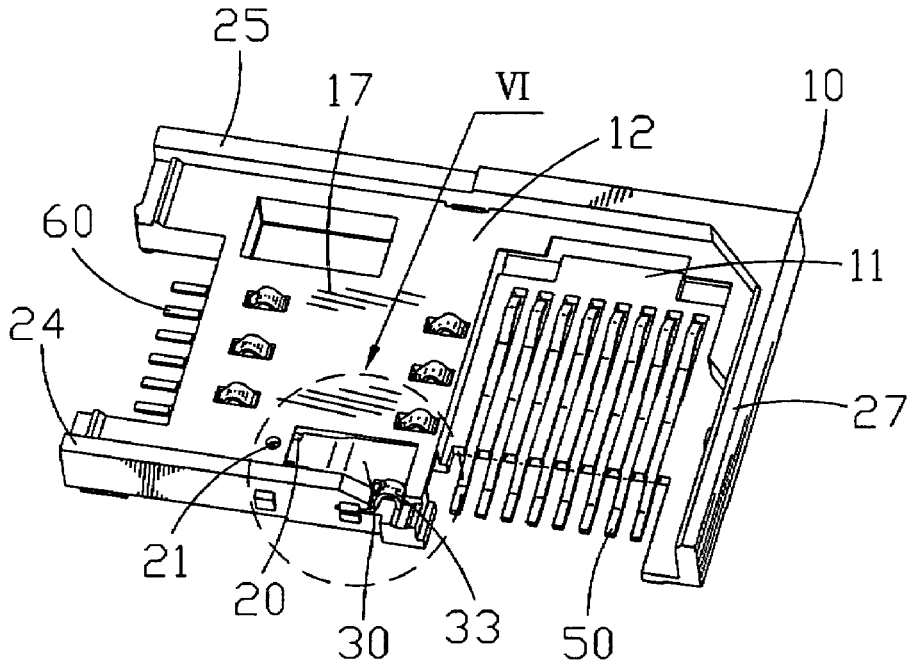
FIG. 5 is an assembled perspective view of the electronic card connector, the cover is not covered on the electric card connector.
Figure 6:
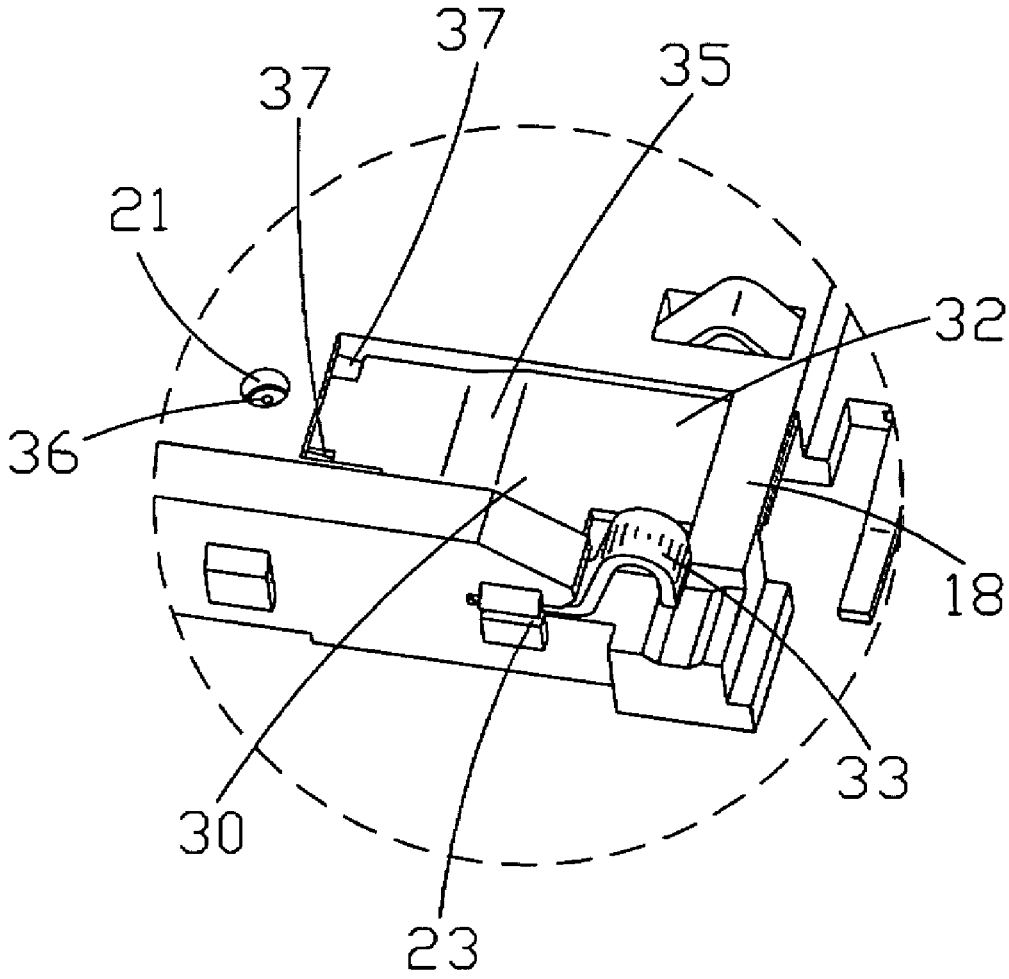
FIG. 6 is a partial, enlarged view of the assembly of the fixing device and the fixed concave.

Referring to FIGS. 5 and 6, the first electric terminals 50 are accepted in the first electric terminal slots 14. The second electric terminals 60 are accepted in the second electric terminal slots 15. The fixing device 30 is accepted in the fixed concave 20 and located on the bracket 13. The sustained piece 32 is located under the pressed plate 18. The left wall 26 and the front end of the sustained piece 32 are in parallel. The limited patch 34 is accepted in the limited groove 23, the end of the limited patch 34 withstood the back end of the limited groove 23. The locating portion 38 is arranged in the left end of the fixed concave 20 and located under the base 17. The protruding lump 36 formed upward on the locating portion 38 is accepted in the fixed hole 21.

Figure 7:
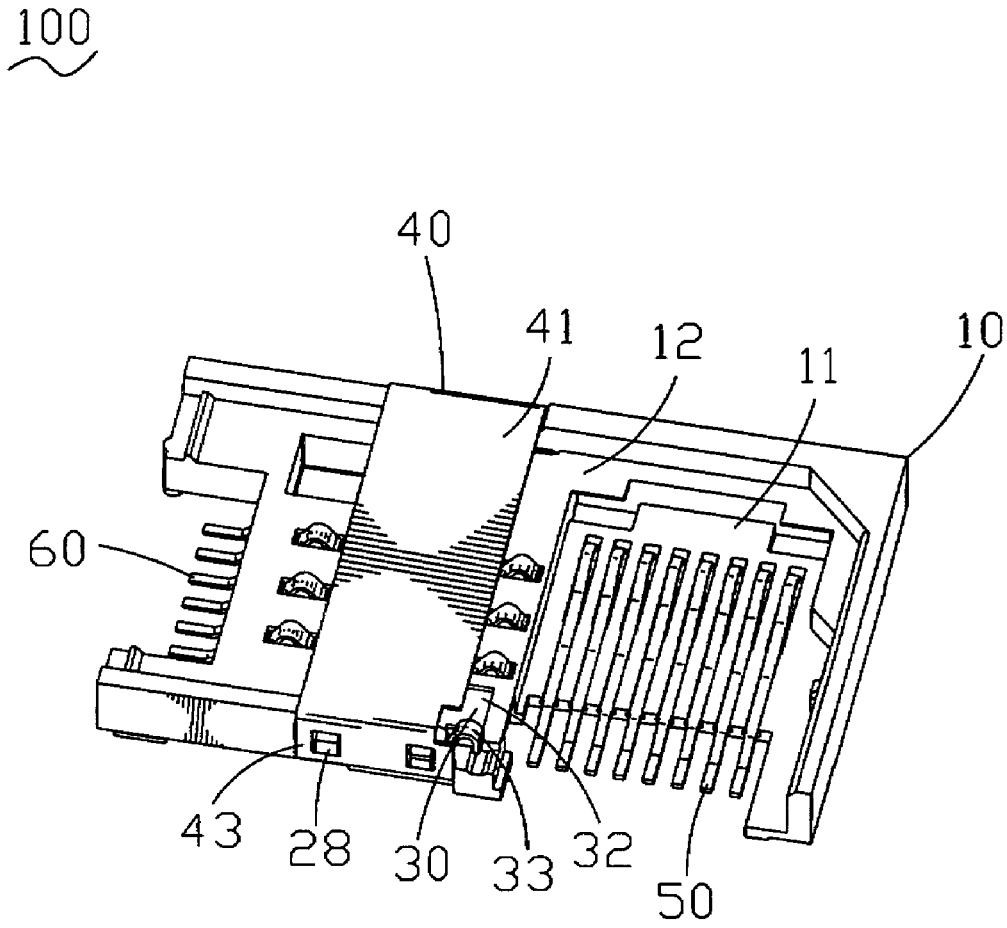
FIG. 7 is an assembled perspective view of the electronic card connector.

Please refer to FIG. 7, the first electric terminals 50 are accepted in the first electric terminal slots 14, the second electric terminals 60 are accepted in the second electric terminal slots 15. The plackets 44 formed in the front side wall 43 and the back side wall 42 cover the lumps 28. The electronic card connector 100 of the present invention is therefore achieved.

Figure 8:
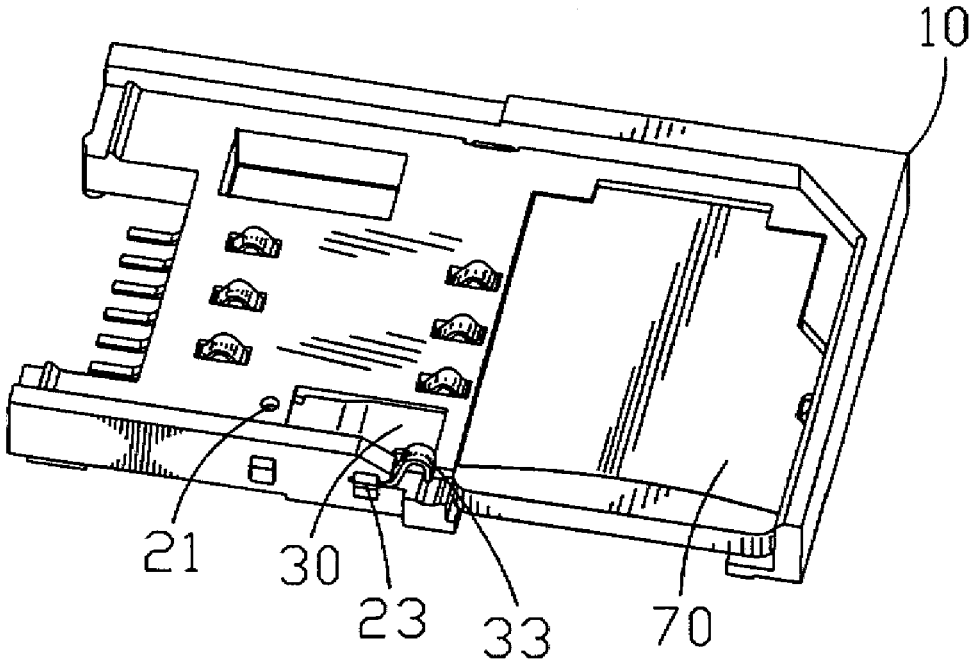
FIG. 8 is an assembled perspective view of the first electronic card and the electronic card connector.
Figure 9:
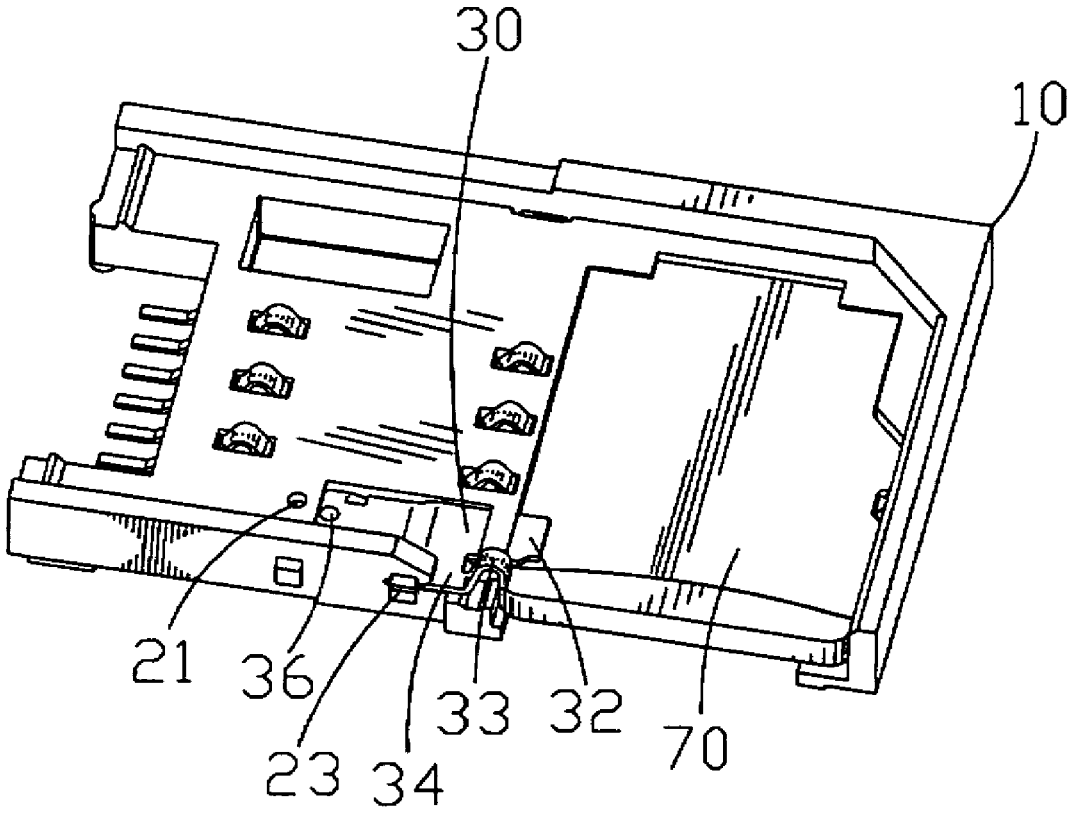
FIG. 9 is an assembled perspective view of the first electronic card and the electronic card connector while the sustained piece covering on the first electronic card.

Referring to FIGS. 8 and 9, the first electronic card 70 is inserted in the first electronic card slot 11. The upper surface of the first electronic card 70 is lower than the base 17. The left side of the first electronic card 70 jostled the left wall 26. The sustained piece 32 and the surface of the first electronic card 70 are leveled equally. While the moved piece 33 is pushed rightwards, the protruding lump 36 is pulled out from the fixed hole 21 as the fixing device 30 is pushed further So that the sustained piece 32 is pulled out from the pressed plate 18 and buckled on the surface of the first electronic card 70, and the sustained piece 32 is pressed downward by the pressed plate 18. The end of the locating portion 38 supports upward the base 17. The connecting portion 35 supports the sustained piece 32, and the sustained piece 32 supports the pressed plate 18. The sustained piece 32 is buckled on the first electronic card 70, so the first electronic card 70 is able to be located in the first electronic card slot 11. Furthermore, the protruding elements 37 resisted the end of the bracket 13 for restricting the fixing device 30 is pushed forward and the protruding lump 36 is pushed out from the base 17 and shown in the fixed concave 20. In this case, the end of the limited patch 34 is retained in the limited groove 23.

Figure 10:
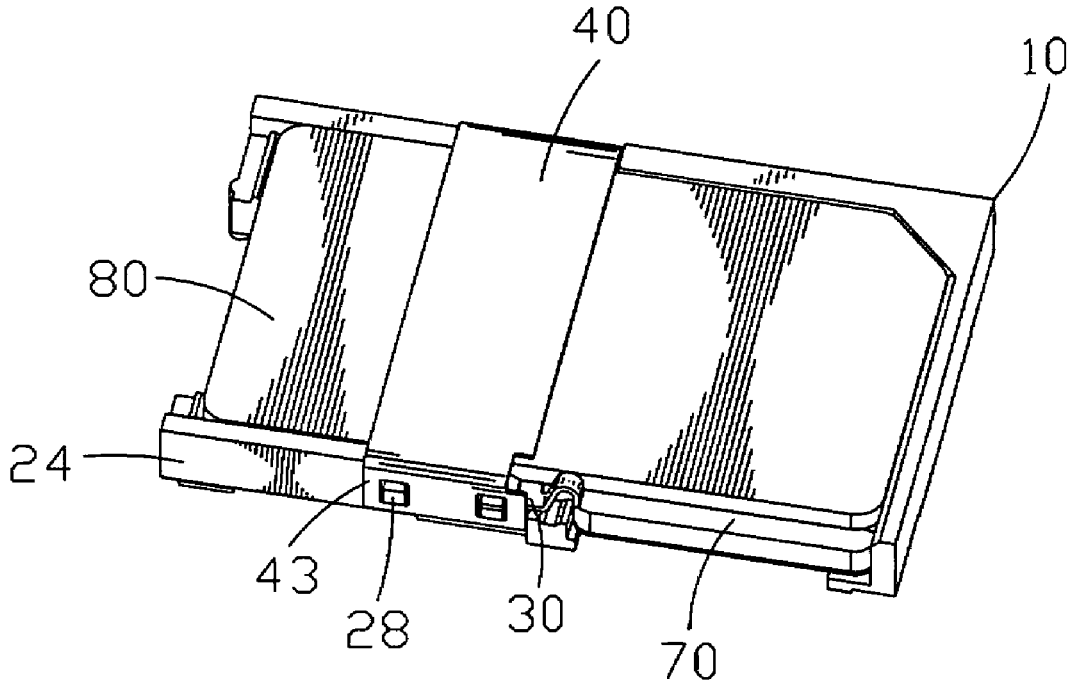
FIG. 10 is an assembled perspective view of the first electronic card, the second electronic card and the electronic card connector.

Please refer to FIG. 10, a second electronic card 80 is inserted in a second electronic card slot 12 The right end of the second electronic card 80 is arranged on the first electronic card 70 The second electronic card 80 and the first electronic card 70 are crossed. So the second electronic card 80 would be covered completely on the first electronic card 70.

After the second electronic card 80 is fetched away the second electronic card slot 12, the first electronic card 70 can be fetched from the first electronic card slot 11. Firstly, the moved piece 33 is pushed leftwards and the locating portion 38 is drove leftwards the protruding lump 36 could slide along the under of the base 17 and finally accepted in the fixed hole 21. At the same time, the sustained piece 32 is located under the pressed plate 18 and at the same level with the left wall 26. The first electronic card 70 is not fastened by the fixing device 30, so the first electronic card 70 can be withdrew from the first electronic card slot 11.

As described above, the sustained piece 32 would cover the first electronic card 70, while the second electronic card 80 is inserted into the second electronic card slot 12 and lays over the surface of the first electronic card 70 The first electronic card 70 transmits signal to an outer circuit constantly.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. An electronic card connector comprising:

a dielectric housing having a generally oblong shape, a first electronic card slot arranged longitudinally in the dielectric housing, a second electronic card slot arranged sidelong in the dielectric housing, the first electronic card slot arranged in a base of the dielectric housing, first electric terminal slots and second electric terminal slots being formed at the bottom of the first electronic card slot and the base of the second electronic card slot respectively, a fixed concave being formed in the base, a bracket being arranged in the bottom of the fixed concave, the fixed concave setting through rightward into the first electronic card slot by the sidewall of the first electronic card slot and formed a pressed plate, the fixed concave extended leftward the bottom of the base;

first electric terminals and second electric terminals located in the first electric terminal slots and the second electric terminal slots; and a fixing device having a sustaining portion, a locating portion and a connecting portion which is connected the sustaining portion and the locating portion, a sustained piece and a moved piece being formed in the sustaining portion, the fixing device being accepted in the fixed concave and located on the bracket, the locating portion located in the left end of the fixed concave, the sustained piece located under the pressed plate.

2. The electronic card connector as set forth in claim 1, wherein the connecting portion is connected slantwise to the sustaining portion and the locating portion.

3. The electronic card connector as set forth in claim 2, further comprising a fixed hole formed in the second base and trough the fixed concave.

4. The electronic card connector as set forth in claim 3, further comprising a protruding lump formed upward on the locating portion and projected into the fixed hole.

5. The electronic card connector as set forth in claim 2, further comprising two protruding elements formed downward at the both sides of the locating portion.

6. The electronic card corrector as set forth in claim 2, further comprising a front wall and a back wall formed in the both sides of the second electronic card slot, a limited groove formed in the front wall, a limited patch extended horizontal from the end of the moved piece, and the limited patch accepted in the limited groove.

7. An electronic card connector comprising:

a dielectric housing with an oblong shape, having a base formed in the dielectric housing, a first electronic card slot located in the base, a plurality first electric terminal slots formed at the bottom of the first electronic card slot, a fixed concave formed in the base, a bracket arranged in the bottom of the fixed concave, the fixed concave though rightward into the first electronic card slot by the sidewall of the first electronic card slot and formed a pressed plate, the fixed concave extended leftward the bottom of the base;

first electric terminals accepted in the first electric terminal slots; and a fixing device having a sustaining portion, a locating portion and a connecting portion which is connected to the sustaining portion and the locating portion, further a sustained piece and a moved piece installed in the sustaining portion, the fixing device accepted in the fixed concave and located on the bracket, the locating portion located in the left end of the fixed concave, the sustaining portion located the underside of the pressed plate.

8. The electronic card connector as set forth in claim 7, further comprising a fixed hole formed in the base and Through the fixed concave, a protruding lump formed upward on the locating portion and projected into the fixed hole.

9. The electronic card connector as set forth in claim 7, further comprising a slot formed between the sustained piece and the moved piece, the moved piece having a vaulted shape.

10. The electronic card connector as set forth in claim 7, further comprising two protruding elements fanned downward at the both sides of the locating portion, the protruding elements resisted the end of the bracket for positioning the fixed device.

11. The electronic card connector as set forth in claim 7, further comprising a front wall formed in one side of the fixed concave, a limited groove formed in the front wall, a limited patch extended horizontal from the end of the moved piece, and the limited patch accepted in the limited groove.

* * * * *